US007465222B1

(12) United States Patent
Sun et al.

(10) Patent No.: US 7,465,222 B1
(45) Date of Patent: Dec. 16, 2008

(54) GRINDING WHEEL

(75) Inventors: Yung-yung Sun, Dali (TW); Chuan-ching Cheng, Taichung (TW)

(73) Assignee: Storm Pneumtic Tool Co., Ltd., Taichung County (TW)

( * ) Notice: Subject to any disclaimer, the term of this patent is extended or adjusted under 35 U.S.C. 154(b) by 0 days.

(21) Appl. No.: 12/000,111

(22) Filed: Dec. 10, 2007

(51) Int. Cl.
*B24B 41/00* (2006.01)

(52) U.S. Cl. ..... 451/342; 451/541; 451/548; 451/510; 403/373

(58) Field of Classification Search ..... 451/342, 451/358, 359, 508, 510, 520, 541, 548; 301/37.31; 403/341, 348, 345, 373
See application file for complete search history.

(56) References Cited

U.S. PATENT DOCUMENTS 3,683,566 A * 8/1972 Walters ..... 451/488
4,393,626 A * 7/1983 Schroer ..... 451/342
4,731,955 A * 3/1988 Henle ..... 451/342
5,658,192 A * 8/1997 Reinauer ..... 451/342
6,332,836 B1 * 12/2001 Tseng ..... 451/359
6,912,755 B2 * 7/2005 Chen ..... 15/179
6,929,538 B2 * 8/2005 Yi ..... 451/359
7,147,550 B2 * 12/2006 Chen ..... 451/520
7,357,702 B2 * 4/2008 Ficai ..... 451/508

* cited by examiner

*Primary Examiner*—Eileen P. Morgan
(74) *Attorney, Agent, or Firm*—Rosenberg, Klein & Lee

(57) ABSTRACT

A grinding wheel includes a grinder engaged between a front cover and a rear cover, and rough portions of the front cover and the rear cover press against the grinder tightly. After center rods and fixed rods of the front cover and the rear cover are passed through center holes and fixing holes of the grinder, a bolt is passed through the fixing hole and secured with the nut to form a grinding wheel.

5 Claims, 5 Drawing Sheets

GRINDING WHEEL

BACKGROUND OF THE INVENTION

1. Field of the Invention

The present invention relates to a grinding wheel, and more particularly to a grinding wheel capable of changing its structural combination.

2. Description of the Related Art

Referring to FIG. 3 for a traditional grinding wheel, a grinder 8 is provided for polishing sheet metals, removing paints, grinding objects and removing rusts. Referring to FIG. 4, the grinder 8 adheres a plurality of lump-shaped rubbing members 81 onto a connecting ring 82 by an adhesive one by one, and each rubbing member 81 is attached centrically to the connecting ring 82 and closely with each other along the circumference of the connecting ring 82, and two covers 9 are covered onto both sides of the connecting ring 82 to form a grinder 8.

However, the rubbing member adhered onto the connecting ring is a lump form and a centric shape, such that when the grinder is driven for its use, the adhered rubbing member may be detached from the connecting ring, which may cause an accident when using the grinder.

As to the manufacture of the traditional grinder, it is necessary to prepare a connecting ring for connecting the rubbing members, and thus incurring additional costs and manpower. In addition, the connecting ring and the rubbing member are adhered with each other, so that when the rubbing member is worn out, users have to dispose the rubber member together with the connecting ring, since the connecting ring cannot be used or replaced separately.

SUMMARY OF THE INVENTION

The primary objective of the present invention is to overcome the foregoing shortcoming of the prior art by providing a grinding wheel to make the installation of components more convenient, while simplifying the components and structure of the grinder to save cost.

To achieve the foregoing objective, the present invention comprises:

a grinder, substantially in a circular disc shape, for grinding or polishing a surface of an object, and having a center hole penetrating through the center of the grinder, and a plurality of fixing holes penetrating through the center hole and the surrounding of the grinder;

a front cover, installed on a side of the grinder, and having a first surface and a second surface, and the first surface being attached closely to the grinder, and a first center rod being disposed perpendicularly at the center of the first surface, and a first penetrating hole being disposed axially at the first center rod, and a plurality of first fixed rods being disposed axially between the first center rod and the surrounding of the first surface, and a second penetrating hole being disposed axially at each first fixed rod, and a first rough portion being disposed between adjacent first fixed rods, and a first circular groove being disposed concavely at the first penetrating hole of the second surface, and a second circular groove being disposed concavely at the second penetrating hole of the second surface;

a rear cover, installed on another side of the front cover corresponding to the grinder, and having a third surface and a fourth surface, and the third surface being attached closely to the grinder, and a second center rod being disposed perpendicularly at the center of the third surface, and a third penetrating hole being disposed axially on the second center rod, and a hexagonal section disposed in the third penetrating hole, and a plurality of second fixed rods being disposed between the second center rod and the surrounding of the third surface, and a fourth penetrating hole being disposed axially on each second fixed rod, and a second rough portion being disposed between adjacent second fixed rods, and a third circular groove being disposed at the third penetrating hole of the fourth surface, and a hexagonal slot being disposed at the fourth penetrating hole of the fourth surface; and a plurality of bolts, each passing through the second penetrating hole into the fourth penetrating hole, for securing a nut.

DETAILED DESCRIPTION OF THE PREFERRED EMBODIMENTS

Figure 1:
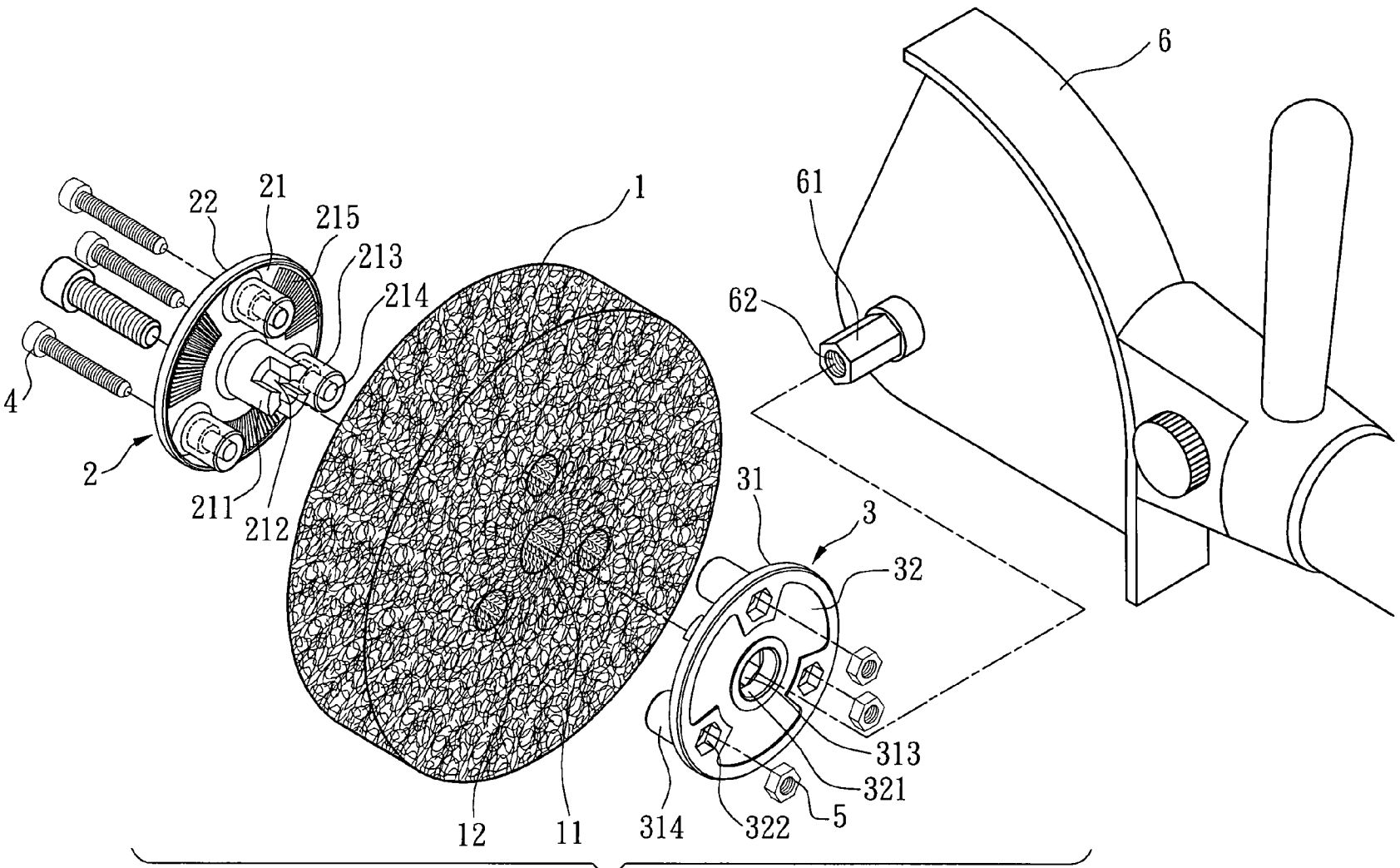
FIG. 1 shows an exploded view of a first preferred embodiment of the present invention.
Figure 2:
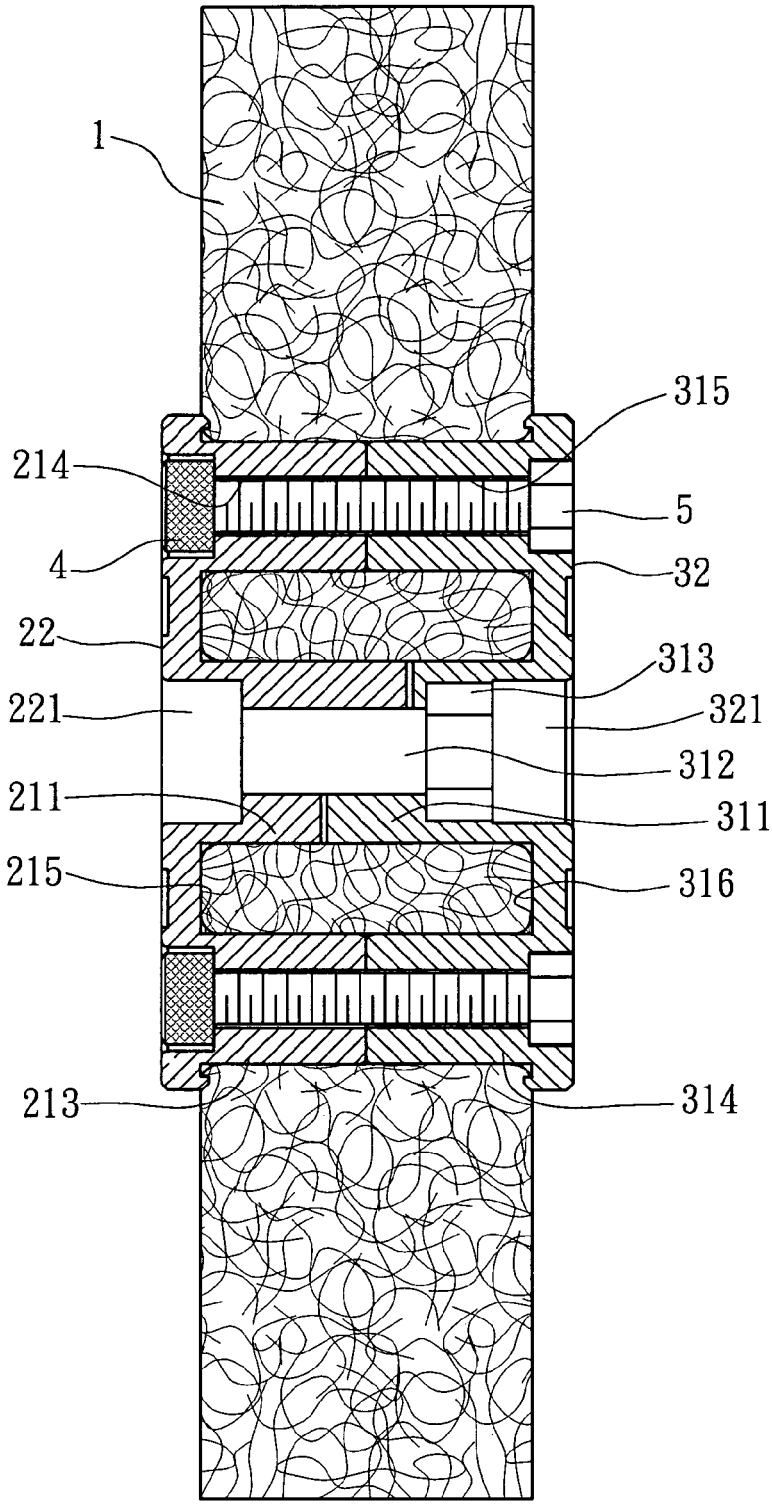
FIG. 2 shows a section view of a first preferred embodiment of the present invention.

Referring to FIGS. 1 and 2 for a preferred embodiment of a structure of the present invention, the embodiment is used for illustrating the invention, but not intended to limit the invention.

In a preferred embodiment of the present invention, a grinding wheel comprises:

a grinder 1, for grinding or polishing a surface of an object, wherein the grinder of this embodiment is made of plastic wires that are irregularly laid out in a substantially fluffy disc shape and contain an adhesive, and the center of the grinder 1 passes through a center hole 11, and a plurality of fixing holes 12 are penetrated through the center hole 11 and the surrounding of the grinder 1;

a front cover 2, installed to a side of the grinder 1, and having a first surface 21 and a second surface 22, and the first surface 21 being attached closely with the grinder 1, and a first center rod 211 being disposed perpendicularly at the center of the first surface 21, and a first penetrating hole 212 being disposed axially on the first center rod 211, and a plurality of first fixed rods 213 being disposed around the first center rod 211 and the first surface 21, and a second penetrating hole 214 being disposed axially on each first fixed rod 213, and a first rough portion 215 being disposed between adjacent first fixed rods 213, and a first circular groove 221 disposed concavely at the first penetrating hole 214 of the second surface 22, and a second circular groove 222 being disposed concavely at the second penetrating hole 214 of the second surface 22;

a rear cover 3, installed to another side of the front cover 2 corresponding to the grinder 1, and having a third surface 31 and a fourth surface 32, and the third surface 31 being attached closely to the grinder 1, and a second center rod 311 being disposed perpendicularly at the center of the third surface 31, and a third penetrating hole 312 being disposed axially on the second center rod 311, and a hexagonal section 313 being disposed axially in the third penetrating hole 312, and a plurality of second fixed rods 314 being disposed around the second center rod 311 and the third surface 31, and a fourth penetrating hole 315 being disposed axially on each second fixed rod 314, and a second rough portion 316 being disposed between adjacent second fixed rods 314, and a third circular groove 321 being disposed at the third penetrating hole 312 of the fourth surface 32, and a hexagonal slot 322 being disposed at the fourth penetrating hole 315 of the fourth surface 32; and a plurality of bolts 4, each passing through the second penetrating hole 214 into the fourth penetrating hole 315 for securing a nut 5.

With the foregoing components and assembly, the grinder 1 is installed between the front cover 2 and the rear cover 3, and a first rough section 215 and a second rough portion 316 of the front cover 2 and the rear cover 3 are used to press against the grinder 1 tightly, and after the first center rod 211 and first fixed rod 213 of the front cover 2 and the second center rod 311 and the second fixed rod 314 of the rear cover 3 are passed through the center hole 11 and the fixing hole 12 of the grinder 1 respectively, a bolt 4 is passed through the first fixing hole 214 to the second fixing hole 314, and the head of the bolt 4 is embedded into the second circular groove 222, and the fourth surface of the rear cover includes a hexagonal slot 322 for embedding the nut 5 and securing and fixing the bolt 4, so as to clamp the grinder 1 to constitute a grinding wheel.

Finally, the bolt 4 is passed through the first penetrating hole 212 of the front cover 2 to the third penetrating hole 312 of the rear cover 3 and locked at an axle hole 62 of an axle 61 of a pneumatic machine 6, and the third penetrating hole 312 includes a hexagonal section 313, for driving the grinder wheel to rotate to achieve the grinding effect, when the grinding wheel is locked at the axle 61 of the pneumatic machine 6.

Figure 3:
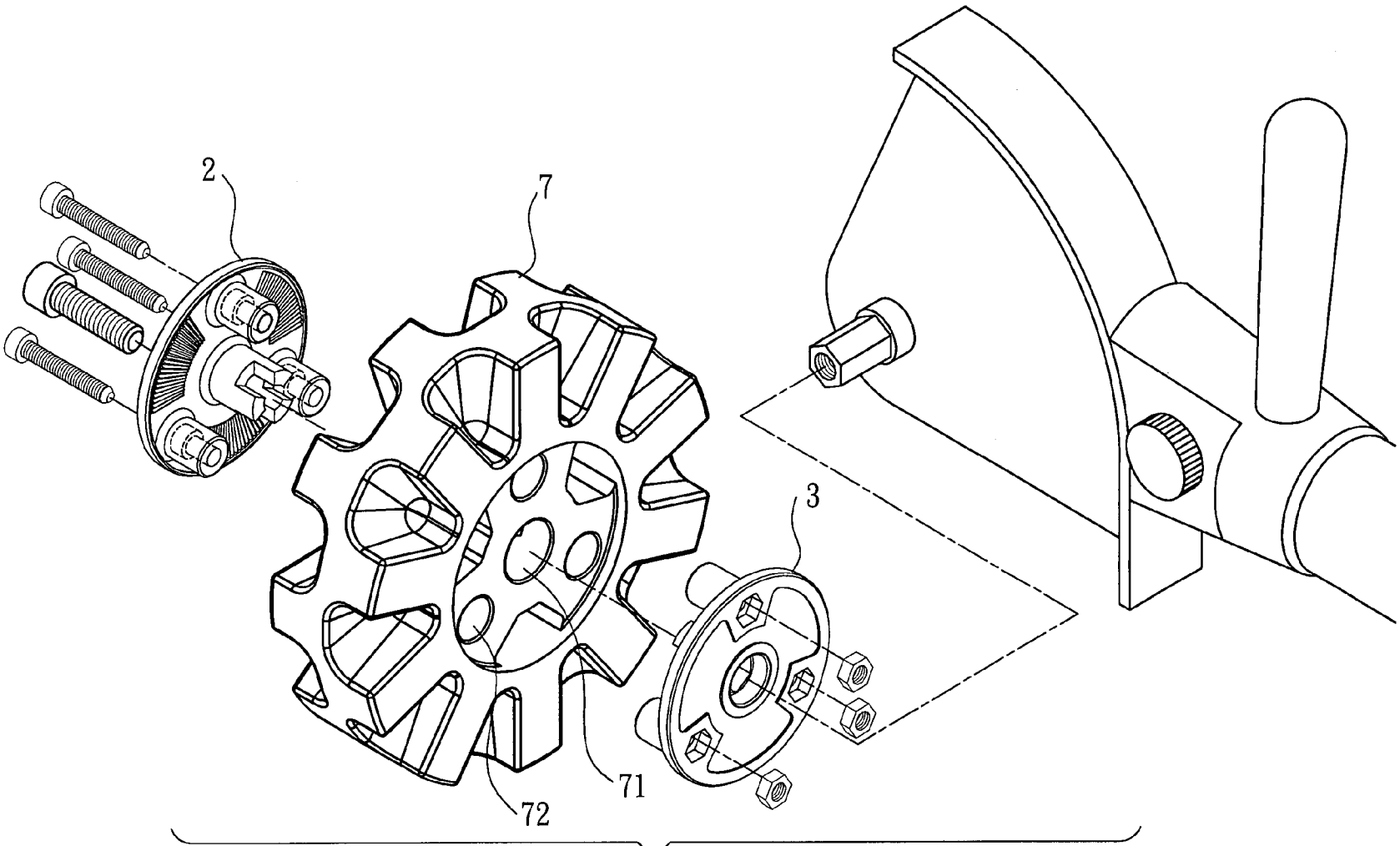
FIG. 3 shows an exploded view of a second preferred embodiment of the present invention.
Figure 4:
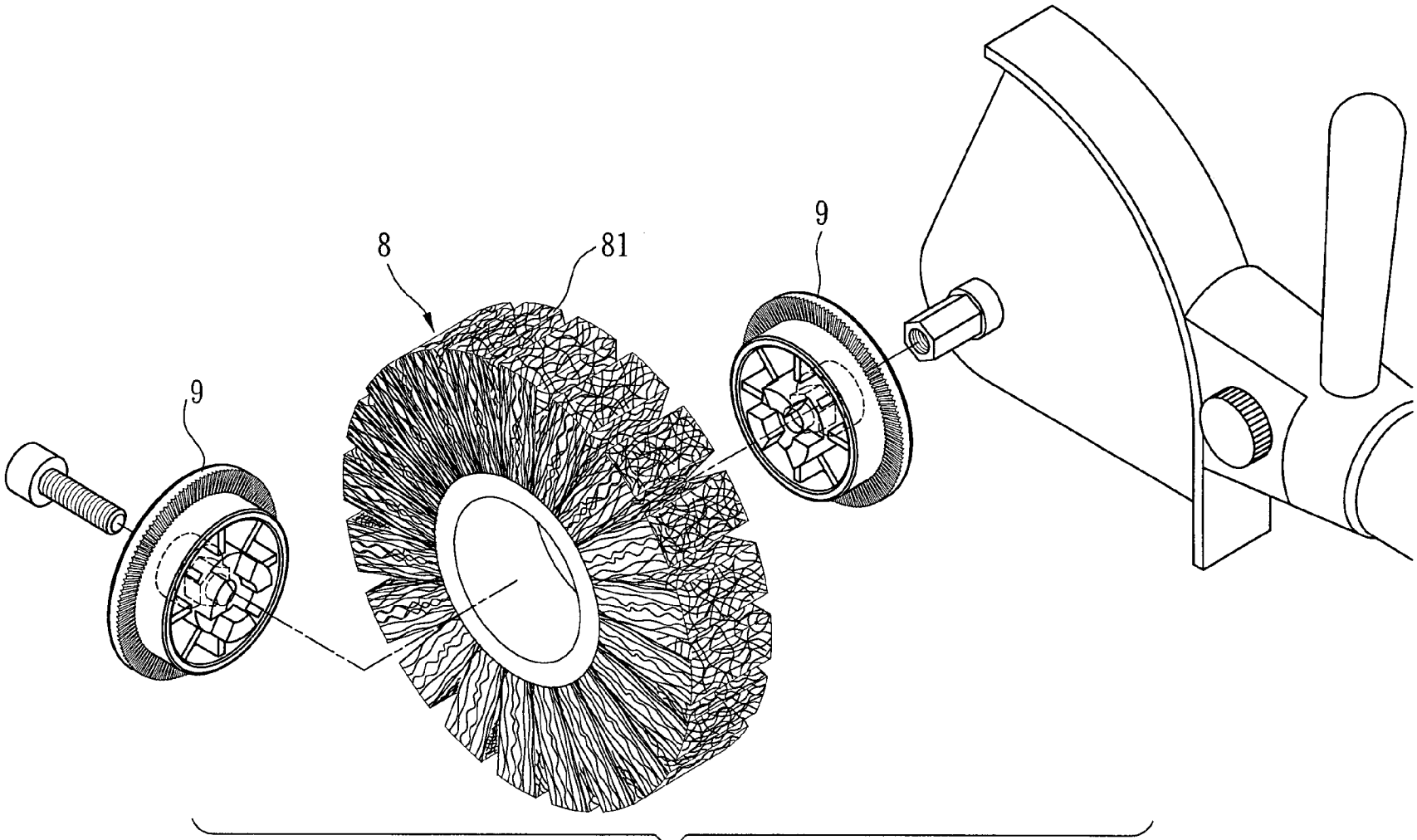
FIG. 4 PRIOR ART
FIG. 4 shows an exploded view of a traditional grinding wheel.
Figure 5:
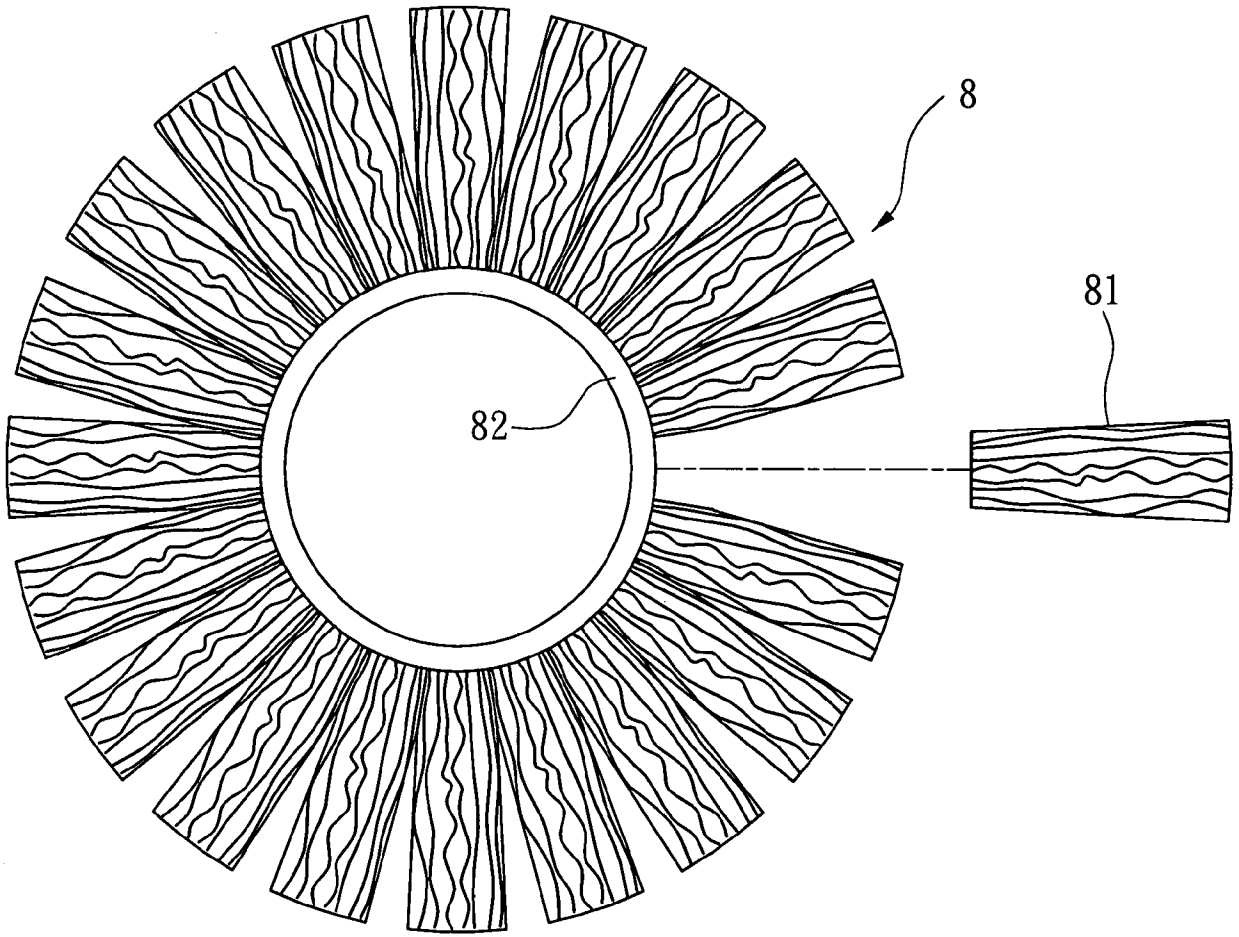
FIG. 5 PRIOR ART
FIG. 5 shows a schematic view of assembling a traditional grinding wheel.

Of course, there are other embodiments of the invention, but they are substantially the same with minor modifications. Referring to FIG. 3 for a second preferred embodiment of the present invention, the grinder is a rubber wheel 7 for grinding or polishing a surface of an object, and the external periphery of the rubber wheel 7 constitutes an alternate concave-convex structure substantially in a circular disc shape, and the rubber wheel 7 has a center hole 71 penetrating the center of the rubber wheel 7, and a plurality of fixing holes 72 are penetrated around the center hole 71 and the rubber wheel 7 for clamping and securing the rubber wheel 7 between the front cover 2 and the rear cover 3, so as to achieve another type of grinding wheel.

Adhesive can be applied between the grinder and the cover for the two aforementioned embodiments to enhance the connection of the grinder and the cover.

In summation of the description above, the installation and removal of the two covers are used for connecting and disconnecting the grinder respectively, such that when the grinder is changed, the cover can be saved for repeated uses, not only reducing environmental pollution, but also allowing the grinder to be manufactured by direct shaping to lower material cost.

What is claimed is:

1. A grinding wheel, comprising:

a grinder, substantially in a circular disc shape, for grinding or polishing a surface of an object, and having a center hole penetrating through the grinder and located radially through the center of the grinder, and a plurality of fixing holes penetrating between the center hole and the periphery of the grinder;

a front cover, installed on a first side of the grinder, and having a first surface and a second surface, and the first surface being attached closely to the grinder, and a first center rod being disposed perpendicularly at the center of the first surface, and a first penetrating hole being disposed axially through the first center rod, and a plurality of first fixed rods being disposed radially around the first center rod, and wherein each first fixed rod has a second penetrating hole disposed axially therethrough, and a first rough portion being disposed between adjacent first fixed rods, and a first circular groove concavely disposed at the first penetrating hole of the second surface, and a second circular groove being disposed concavely at each of the second penetrating holes of the second surface;

a rear cover, installed on a second side of the grinder opposite of the front cover, and having a third surface and a fourth surface, and the third surface being attached closely to the grinder, and a second center rod being disposed perpendicularly at the center of the third surface, and a third penetrating hole being disposed axially through the second center rod, and a hexagonal section being disposed axially in the third penetrating hole, and a plurality of second fixed rods being disposed radially around the second center rod wherein each second fixed rod has, and a fourth penetrating hole disposed axially therethrough, and a second rough portion being disposed between adjacent second fixed rods, and a third circular groove being disposed at the third penetrating hole of the fourth surface, and a hexagonal slot being disposed at the fourth each of penetrating holes of the fourth surface;

wherein the grinding wheel is engaged between the front cover and the rear cover such that the first center rod engages the second center rod through the center hole and the first fixed rods respectively abut the second fixed rods through the fixing holes; and a plurality of bolts, one bolt passing through each of the second penetrating holes into the fourth penetrating holes for securing a nut and for clamping the front cover to the rear cover.

2. The grinding wheel of claim 1, wherein the grinder is made of plastic wires that are laid out irregularly and contain an adhesive.

3. The grinding wheel of claim 1, wherein the grinder is a rubber wheel, and an external periphery of the grinder is an alternate concave-convex structure.

4. The grinding wheel of claim 1, wherein the hexagonal slot is provided for embedding a nut.

5. The grinding wheel of claim 1, wherein the first surface of the front cover and the third surface of the rear cover are fixed with the grinder by an adhesive for enhancing the fixation.

* * * * *